United States Patent [19]

Kober et al.

[11] 4,342,797

[45] Aug. 3, 1982

[54] WET FLOW CHARACTERISTIC OF COAL AND OTHER WATER-INSOLUBLE SOLID PARTICLES

[75] Inventors: Alfred E. Kober, Bridgewater; Mark O. Kestner, Mendham, both of N.J.

[73] Assignee: Apollo Technologies, Inc., Whippany, N.J.

[21] Appl. No.: 55,029

[22] Filed: Jul. 5, 1979

[51] Int. Cl.[3] ..... C09K 3/00

[52] U.S. Cl. ..... 427/220; 44/6; 252/384; 427/212

[58] Field of Search ..... 44/6; 106/13; 252/70, 252/384; 427/220, 221, 212

[56] References Cited

U.S. PATENT DOCUMENTS

| | | | |
|---|---|---|---|
| 2,973,254 | 2/1961 | Schmidt | 44/1 R |
| 3,202,501 | 8/1965 | Pettersson | 252/384 |
| 3,378,493 | 4/1968 | Jacoby | 423/367 |
| 3,402,065 | 9/1968 | McDonald | 427/220 |
| 3,428,571 | 2/1969 | Jacoby | 252/70 |
| 4,029,608 | 6/1977 | Muratg | 252/551 |
| 4,094,805 | 6/1978 | Hansen | 106/13 |
| 4,117,214 | 9/1978 | Parks | 106/13 |
| 4,163,079 | 7/1979 | Beafore | 106/13 |
| 4,175,143 | 11/1979 | Speigal | 427/220 |
| 4,185,988 | 1/1980 | Kistler | 427/221 |

FOREIGN PATENT DOCUMENTS

| | | | |
|---|---|---|---|
| 253567 | 4/1962 | Australia | 427/220 |
| 2122890 | 11/1972 | Fed. Rep. of Germany | 427/221 |
| 4410898 | 2/1969 | Japan | 44/6 |
| 400009 | 10/1933 | United Kingdom | 44/6 |
| 738061 | 7/1953 | United Kingdom | 44/6 |

OTHER PUBLICATIONS

Can J. Phys. vol. 36 (1958).

*Primary Examiner*—Sam Silverberg
*Attorney, Agent, or Firm*—James and Franklin

[57] ABSTRACT

The wet flow characteristic of water-insoluble solid particles such as coal is enhanced by forming on the surface of the solid particles a coating of a fluid having the property of lowering surface tension in aqueous solution, preferably a water solution of a substance from the group consisting of methyl and dimethyl naphthalene sulfonates and ethoxylated linear secondary alcohols, the substances being highly water soluble and the water solution having a low viscosity, a high flash point and low toxicity.

25 Claims, No Drawings

WET FLOW CHARACTERISTIC OF COAL AND OTHER WATER-INSOLUBLE SOLID PARTICLES

The present invention relates to a treatment of water-insoluble solid particles such as coal to enhance their flow characteristics when wet.

Many substances are produced, transported, stored, and particularly conveyed in the form of small particles. It is essential that those particulate substances flow in a fairly ready fashion. If they do not, if they form cakes or large masses, or if piles of such particles become in effect a single mass of adhered-together material, the substances in question can no longer be effectively utilized—if piled they will not flow readily from those piles, and if conveyed they will tend to clog, particularly at constricted portions of the conveying path, and thus block feed substantially or altogether. If any of these things occur much time and trouble, and consequently expense, must be exerted in order to restore to the particles their necessary free-flowing relationship.

There are many things which may cause pulverulent material to cake and clog, but one of the most prevalent, and most effective, clogging agents is water. Materials of the type under discussion are quite frequently exposed to moisture—when stored in weather-exposed piles or containers, when conveyed in the open, or when stored or conveyed inside buildings where the humidity is high or where water may be splashed onto the particles. A pile of finely granulated coal, for example, which flows readily when dried may become virtually unmanageable if rained on. In a storage hopper, the use of which is common in a utility storage facility, for example, or in a freight car full of finely divided coal, under normal circumstances the coal will flow freely when the bottom gate of the hopper or coal car is opened, but that coal may become in effect a solid block of coal filling the hopper or freight car when rained on; before the hopper or freight car can be unloaded, something must be done to restore the coal to its free-flowing normal condition. Moreover, even if the coal will flow out of the hopper or freight car, it may still be sufficiently lumpy, or otherwise flowresistant, as to build up in and block a portion of the conveyor path through which it is to be transported, thus stopping all operations until that blockage is cleared.

In the past attempts to ameliorate this problem as it affects coal and other water-insoluble solids, such as pelletized ores and the like, has been both expensive and relatively ineffective. The application of heat will of course eventually cause the moisture which binds the particles together to evaporate, but to do that to a freight car full of pulverized coal is no mean task—blowing hot air is expensive, and where the heat must penetrate the pile and cause the moisture at the inside of a large pile to evaporate, the blowing of air must be carried on for a very long period of time. Attempts have been made to solve the problem through the use of centrifugal dryers, but that approach too is expensive and time-consuming, and, moreover, it can only be utilized where the pile of coal is sufficiently broken up so that clumps of the coal can be moved from the pile to the dryer. If the entire pile has solidified into one mass, the centrifugal dryer cannot be used.

Another approach has been to add to the pile of material, while the material is still dry, some water-absorbing substance such as starch or other suitable powdered material. This does tend to keep the pile of powdered material flowing, but the starch when used in effective amounts is rather costly, and the presence of the starch may undesireably affect the characteristics of some types of granulated material.

A comparable problem arises in connection with piles of granular water-soluble material, such as detergents or fertilizers such as urea. When moisture attacks these water-soluble particles, the particles tend to dissolve in the water to a greater or lesser degree and then to crystallize, crystal bridges forming between adjacent particles, thereby bonding those particles together, or, more accurately, causing the particles to coalesce to some degree. A known approach to the prevention of caking of such water-soluble materials has been to add to the material a suitable surfactant, which functions to inhibit the formation of the crystal bridges between particles (the surfactant accomplishing this result by preventing the particles from dissolving into the water) and to modify the characteristics of such crystal bridges as may form. However, with water-insoluble particles like coal, there is no need to use external agents to prevent solution of the particle into the water; the nature of the particle is such that no such solution will take place under normal circumstances. Hence the use of surfactants with particulate material of a water-insoluble nature would appear to be contra-indicated.

Surprisingly, we have discovered that if surfactants are used to coat water-insoluble particles such as coal or comparable materials, a very considerable improvement in the flow characteristics of those materials is observed even when they are moist or quite wet. The surfactant does this with water-insoluble materials by a mechanism quite different from that involved in the use of surfactants with water-soluble particles. With water-insoluble particles the surfactant forms a coating on the particles which reduces the surface tension of moisture on the surface, and thus renders the particles far less susceptible to the coagulating or aggregating action of ambient moisture or water.

While experimental results indicate that surfactants generally have this effect on piles of granulated water-insoluble materials, it appears that only some surfactants have any practical capability in that connection. The surfactant should be applied to the particles in the form of a water solution, and therefore the surfactant material should be highly water-soluble. The surfactant solution must have a relatively low viscosity, in order that it can be applied to the particles conveniently and efficiently, as by spraying, or by causing the particles to pass through a mist of the surfactant solution as they are on their way to the freight car, other storage space or point of use, such as a furnace. For safety's sake, the surfactant solution should have a high flash point, so that it will not pose a fire hazard. Moreover, because the piles of material are often exposed, and thus accessible to domestic animals and possibly even to children, and because those involved in handling and transporting the material must be protected against injury, the solution must have a low toxicity.

It is therefore a prime object of the present invention to provide a commercially practicable method for improving the wet flow characteristics of coal and other water-insoluble solid particles.

It is a further object of the present invention to provide such a procedure which can be carried out effectively and inexpensively, without requiring any special handling of the particles, and without adversely affecting the normal use of those particles.

To that end, and in accordance with the present invention, the water-insoluble particles in question, either when they are in a pile or, preferably, while they are being transported to the place where they are to be piled, are treated with a water solution of low viscosity, preferably in the form of a spray, the solute being a readily water-soluble substance having the property of lowering surface tension in aqueous solution. Sufficient of this water solution is applied to the water-insoluble particles so as to form on the surface of those particles a coating of that solution. The existence of this coating prevents caking and causes the particles to slide readily over one another and over the surfaces of the enclosure in which they may be contained even when the particles are quite wet. As a result, the particles will flow efficiently and effectively despite the presence of an appreciable amount of water.

To the accomplishment of the above, and to such other objects as may hereinafter appear, the present invention relates to a method of inhibiting the caking tendencies of water-insoluble solid particles, as defined in the appended claims and as described in this specification.

When the surfactant water solution is applied to the water-insoluble particles, some of that solution may, depending upon the physical nature of the particles, be absorbed into the particles. Such absorbed portion of the surfactant solution plays no effective part in improving the flow characteristics of the particles. It is only the non-absorbed portion of the surfactant solution which forms a coating on the particles and thus produces the desired effect. Hence the solution of surfactant must be applied in sufficient excess over that absorbed in the particles so as to form on the particles the desired surfactant coating. The degree to which the particles will absorb the surfactant is dependent in part on the physical nature of the particles themselves, and in part on the amount of time that elapses between the application of the surfactant to the particles and the arrival of the particles at their point of end use. For example, if coal particles are being conveyed from a storage pile to a furnace where they are to be burned and if the conveying is continuous, only a very limited period of time will elapse between the spraying of the particles with the surfactant and the combustion of the particles in the furnace, in which case little absorption of the surfactant will occur even if the particles themselves are comparatively absorptive in nature. On the other hand, if the particles are being conveyed from a freight car to a storage pile, in which pile the particles may remain from an appreciable period of time, there will be ample time for the particles to absorb as much surfactant as they can. In the former situation less of the surfactant will be required than in the latter situation in order to form on the particles the operative coating.

The term "surfactant" is here used to mean a substance having the property of lowering surface tension in aqueous solution. Particulate bituminous, sub-bituminous and lignite coals are the water-insoluble materials to which the tests set forth in this specification are specifically directed, but it will be understood that they are but typical of water-insoluble particles as a class. For example, the instant invention is quite applicable to the treatment of pulverized ores of various compositions.

In order to determine the effect of moisture on reducing the flow characteristics of coal, and to determine the ameliorative effects of selected surfactants when used in connection with coal particles, two different experimental methods were used. One procedure used a shear test cell apparatus that was designed and constructed especially for the purpose. The second method required modifications to a commercially available slide angle tester and the operating procedures used for it.

The shear test cell was constructed from a 4½ inch length of 3⅛ inch I.D. steel pipe. The pipe was cut into two lengths of 2 and 2½ inches, and the mating surfaces of the two lengths were polished to a smooth finish. Alignment of the two lengths about the common axis was maintained by three pins, each passing through a set of flanges welded onto each segment of the pipe. The flanges were recessed 1/32 inch from the polished surfaces so as not to interfere with sliding motion of one piece relative to the other.

In operation, the two segments, held together with the pins, were mounted on a flat plate with the 2 inch segment beneath the 2½ inch one. The bottom section was clamped, and the top section was connected to a weight platform by a string passing over a stationary pulley. The same side of the test cell faced the wheel and platform in every test.

The coal or other sample to be evaluated for shear strength (resistance to flow), usually 360.0 g, was poured into the apparatus, broken up by inserting a spatula blade downward through the coal (with the insertions 45° apart), leveled by tapping, and compressed with a 4719 gram weight for 5 minutes. After the compressing weight and pins were removed, the shear strength of the column of coal was determined by adding weights to the platform in 10-gram increments, to apply lateral force to the top part of the cell until it was pulled off of the bottom.

The second procedure used a commercial slide angle test apparatus which is designed to raise the slope of a plastic tray so as to measure the angle from the horizontal at which a material on that tray will move. Several modifications were made to this apparatus. As received, it was designed to form a pile of solids on a plastic (Nalgene) tray by dropping the solids through a powder funnel, similar to the standard angle of repose test. However, the surfaces in contact with the solids in most commercial materials handling and transfer equipment are made of steel. Therefore, plates of AISI 316 stainless steel were cut to fit into the plastic tray for these tests.

The procedure for forming the pile was also not satisfactory, as piles of identical material so formed in replicate tests slide at widely varying angles. The method of pile formation was, therefore, modified as follows: The stem of a Nalgene funnel was plugged. To this funnel, supported in the upright position, was added the coal or other sample to be tested (36.0 g). The coal was leveled with a spatula blade, so as not to protrude above the top of the funnel, and the plastic tray containing the stainless steel plate was inverted over the funnel, with the funnel against the end wall of the tray. The entire apparatus was then inverted and placed in the baseplate, with the funnel at the end away from the pivot. The funnel was slowly lifted, while being held against the end wall to avoid lateral movement, without disturbing the pile. Each replicate trial of single samples produced a stable pile of reproducible dimensions and degree of compaction. The angle of the baseplate was raised in steps of ½°. The behavior of each pile depended on the concentration of the water on the coal and on the presence of additive. Piles of wet coal generally slide intact down the steel plate without cleaving. Piles of treated coal generally first cleaved, then the remainder of the pile slid at steeper angles.

In order to determine the angle of which these treated coal piles would slide on the steel if they had not cleaved, the tests were modified such that the inverted funnel was left on the pile of coal which would not cleave and thus retain its shape as the angle of the plate was raised. The shear test cell was used for most of the testing. The slide angle tester was used to obtain data on some of the more effective additives under conditions which more closely resembled those under which these additives might actually be used.

Before testing, coals or other materials were dried of surface moisture by storage for 2–3 hours in an oven at 120°–130° F. Additions of water and treatment(s) were calculated on the basis of this surface-dried coal.

In one series of tests the shear test cell was used in connection with a Pennsylvania bituminous coal having the following size distribution:

| Size Range, Mesh | % |
|---|---|
| 4–16 | 22.6 |
| 16–30 | 31.6 |
| 30–50 | 24.4 |
| 50–100 | 10.4 |
| 100–200 | 4.4 |
| 200–270 | 1.4 |
| Minus 270 | 5.2 |

The untreated coal was first tested at various surface moisture concentrations, to determine the point at which resistance to flow was a maximum. This was found to occur at 12% surface moisture, and the subsequent screening tests were therefore carried out at that moisture level.

Further tests were carried out on piles of 4–30 mesh Pennsylvania bituminous coal. A dry pile of that coal would not form a stable cone, falling apart when the inverted funnel was removed. As the angle was then raised, the pile both cleaved and slid in spurts, with no definite point at which sliding began.

A pile of the same coal treated with 12% water did not cleave, but rather slid intact down the steel plate at an angle of 26° from the horizontal. As the angle was increased further, the pile then cleaved at angles of between 35° and 45°.

When this wet coal was treated with a flow improver of the type hereinafter described, it behaved differently. A pile formed from these treated coals settled more compactly when the funnel was inverted. As the angle was increased, the pile first cleaved before sliding, then what was left of the pile slid in spurts as the angle was raised further. This cleavage before sliding represents a desirable modification of the properties of the wet coal.

In order to determine the angle at which these treated coal piles would slide on the steel, the tests were repeated with the modification that the inverted funnel was left on the pile of coal, so that the pile could not cleave and thus retained its shape as the angle of the plate was raised. In these cases, the flow improvers did also generally reduce the angle at which the pile slid on the steel plate.

Because of constraints resulting from the requirements of commercial handling and feeding systems for coal and the like, and in order to facilitate distribution of treatment material throughout the coal on standing, materials that showed appreciable solubility in water were selected for testing, since the application to the piled material of treatment material in the form of a spray seemed to be very strongly indicated. With that in mind, the principal surfactants tested were:

| | |
|---|---|
| Witconate PIO-59 (Witco-Chemicals) | Alkylaryl Sulfonate |
| Witconol Apem, PIO-59 (Witco Chemicals) | Alkoxylated Myristol Alcohol |
| Aerosol OT-75 (Am. Cyanamid) | Sodium Dioctyl Sulfosuccinate |
| Aerosol A-102 (Am. Cyanamid) | Disodium Ethoxylated Alcohol Sulfosuccinate |
| Aerosol 200 (Am. Cyanamid) | Disodium Alkyl Amidopolyethoxy Sulfosuccinate |
| Aerosol A-103 (Am. Cyanamid) | Disodium Ethoxylated Nonylphenyl Sulfosuccinate |
| Aerosol OS (Am. Cyanamid) | Sodium Isopropylnapthalene Sulfonate |
| Aerosol A-413 (Am. Cyanamid) | Disodium Alkyl Amidoethoxy Sulfosuccinate |
| Aerosol 501 (Am. Cyanamid) | Proprietary |
| Petro AG Special Petrochemical Co. Inc.) | Methyl-and Dimethylnapthalene Sulfonate |
| Tergitol 15-S-7 (Union Carbide) | Ethoxylated Linear Secondary ($C_{11}$–$C_{15}$) Alcohols |
| Triton DF-18 (Rohm & Haas) | Proprietary |
| Triton X-100 (Rohm & Haas) | Ethoxylated Octylphenol |
| HallComid M-18-OL (Hall Chemicals) | Proprietary |
| HallComid M-18 (Hall Chemical) | Proprietary |

All were found to significantly increase the flowability of wet or moist coal, but because two of the listed surfactants, Tergitol 15-S-7 and Petro AG Special, also met the other practical criteria of high water solubility, low viscosity of aqueous solutions, high flash points, and low toxicity ($LD_{50}$ greater than 1000 mg/kg), further detailed testing was limited to those two substances.

The water solution of surfactant was applied to the masses of pulverized coal by means of a spray, since this is the method most likely to be employed in industry. It was found, in general, that the spraying of rather small amounts of surfactant water solution onto coal had little or no effect in improving wet flow. As the amount of surfactant solution was increased wet flow characteristics improved up to a point, and thereafter little or no improvement in flow characteristics was observed as the amount of surfactant solution was increased. It is believed that this effect occurs because the coal particles, although not water soluble, are porous. The first portion of surfactant solution is absorbed into those particles and, because absorbed, does not appreciably enhance flow characteristics. (The degree of absorption is, however, time-related, as explained above.) Once the coal particles have absorbed that which they can or will absorb in the time involved, additional surfactant solution forms a coating on the outer surface of the particles, and it is the existence of this coating which produces the enhanced wet flow characteristics. Once a full coating of the particle has been achieved, further application of the surfactant solution is superfluous, and performs no appreciable useful function. The minimum amount of surfactant water solutions to be employed with a given pile of water-insoluble particles will, therefore, vary depending upon the porosity or absorbing characteristic of those particles, and hence will in essence have to be empirically determined for each application. The maximum amount of surfactant solution for a given pile of particles will in the main be determined by economic (cost) factors.

In one series of tests on coal piles, using a 20% aqueous solution of the Tergitol 15-S-7, the results shown in Table I were observed.

TABLE I

| Additive | Treatment Rate Pints/ton | Pile Unconfined: Nature of First Movement | Pile Unconfined: Angle of First Movement | Pile Confined: Angle of Slide |
|---|---|---|---|---|
| None | — | Slid | 26° | 26° |
| Tergitol 15-S-7 | 2 | Cleaved | 23° | 24½° |
| Tergitol 15-S-7 | 4 | Cleaved | 20° | 21° |

In another series of tests, the dense, compacted deposits of wet coal fines taken from a downcomer were analyzed for 26% total moisture and 21% surface moisture. Specimens were dried to 0% total moisture and ground to pass a 30-mesh screen. All the material passed 30 mesh. The dry, ground sample was reconstituted to 26% total moisture. DW-9X (a 20% aqueous solution of Tergital 15-S-7) and DW-11X (a 50% aqueous solution of Petro AG Sp) were applied at treatment rates corresponding to 2.5 and 5.0 pints/ton. The results of shear strength tests, listed in Table II, show that both materials reduced the internal coefficient of friction of the specimens anywhere from 8.1 to 54% depending on the additive and treatment rate.

TABLE II

SHEAR STRENGTH TEST DATA FOR WET COAL DEPOSITS

| Additive | Treatment Rate (pts/ton) | Total Moisture (%) | Shear Strength (gms) | % Reduction In Shear Strength* |
|---|---|---|---|---|
| None | 0 | O (dry) | 500 | — |
| None | 0 | 26.0 | 1425 | — |
| DX-9X | 2.5 | 26.0 | 1350 | 8.1 |
| DW-9X | 5.0 | 26.0 | 1100 | 35.1 |
| DW-11X | 2.5 | 26.0 | 1000 | 45.9 |
| DW-11X | 5.0 | 26.0 | 925 | 54.0 |

$$*\% \text{ Reduction} = \frac{1425 - \text{Experimental Shear Strength}}{1425 - 500}$$

In another series of tests the results of which are set forth in Table III a 30–100 mesh fraction of bituminous coal was tested at 14% surface moisture (maximum shear strength) and at 2.5 pints per ton of additive.

TABLE III

| Ingredient(s) | Concentration(s) | Shear Strength, Grams |
|---|---|---|
| — | — | 700[a] |
| — | — | 990[b] |
| Tergitol 15-S-7 | 20% | 880 |
| Petro AG Sp | 16% | 920 |

[a]Dry coal, no additive
[b]Coal with 14% surface moisture, no additive

These surfactant formulations were also tested for effectiveness with a lignite. They reduced the resistance to flow of compacted −30 mesh lignite fines between 8 and 54%.

Experimental field tests have demonstrated the utility of the instant invention. In one such field test a bunker was clogged with coal to about one-third of its diameter and three-quarters of its height and the vibrators provided on the bunker to cause the coal to flow were only intermittently and incompletely effective. Station personnel had been using air lances for four days around the clock to try to break up the clogging, but with no success. DW-9X, a 20% aqueous solution of Tergitol 15-S-7, was injected into the clogged pile by air lances inserted into the pile at distances between three feet and ten feet, and later the surfactant solution was also applied to the exposed bunker walls. After three hours of application of the DW-9X the clog cleared. As the coal flowed from the bunker several large lumps were present, but all but one of those lumps fed through the feeder without requiring any action. Only one lump had to be broken up at the feeder coal flow pipe.

In another utility installation coal arrived by rail and was stock-piled oustside the plant. Periodically that coal was conveyed to bunkers which were designed to retain 24–30 hours of coal at 100% mill capacity. From the bunkers, the coal falls onto a feeder belt where the coal flow is regulated and measured being used. From the feeder the coal falls through a chute which makes a 53° angle turn just prior to entering the mill and it was at that turn the coal was plugging when the coal moisture content reached approximately 9%. In the fifteen hours prior to the field test here described, plugging occurred fifteen times, for a total down time of 298 minutes. To clear the chute when it plugged required two men to air lance the coal through a two inch access port, a task that took approximately twenty minutes for each pluggage. When the coal was treated with a 20% aqueous solution of Tergitol 15-S-7 at the rate of 4.6 pints per ton no plugging occurred while the feeder was operated at 40% of capacity for three hours. Then the feed was raised to 60% of capacity and the feed of the surfactant solution was correspondingly raised to maintain the rate of 4.6 pints per ton. No pluggages occurred in approximately thirteen hours of operation. Other similar feed systems in the plant operating over the same time with the same coal averaged six pluggages per conveyor line. The test ended when there was an interruption in the feed line for the surfactant caused by a plugged filter.

On another occasion one of the feed lines was plugging approximately every hour when the coal had a moisture content of 9.9%. The same surfactant was added at the rate of six pints per ton, and that was followed by over twelve hours of operation without any pluggage. Thereafter the feeding rate of the surfactant was varied and results observed. Optimum results were achieved at a treatment rate of 8.3 pints per ton, when the system ran for a day without any pluggage. That run was terminated only when the supply of surfactant ran out, and the feed system plugged one hour thereafter.

To establish the mechanism by means of which the surfactant solutions accomplish the observed flow-enhancing effect on these water-insoluble particles, samples of coal were treated with solutions of known surface tension ranging from 72.4 (water) to 30.0 dyne/cm (10,000 ppm of Tergitol 15-S-7) and subjected to the shear test. The results listed in Table IV show no effect on shear strength at concentrations of less than 1,000 ppm of active ingredient. No correlation between shear strength and surface tension was observed below this value. This is due to the fact that the additive is absorbed into the coal. This was verified by measuring surface tension before and after a solution of known concentration of Tergitol 15-S-7 was stirred with 25 gms of −100 mesh coal, a considerably finer particle size than is normally to be found in commercial coal. A 100 ppm solution of surface tension=32.7 dynes/cm was stirred with coal for two hours and filtered. The filtrate was found to have a surface tension of 67.2 dynes/cm indicating that 90–99% of the additive was absorbed. As shown in Table V a 10,000 ppm solution retained a low surface tension under similar conditions.

TABLE IV

Effective of Tergitol 15-S-7 Concentration on Properties of Solutions and Coal Treated with Them

| Concentration in Water (ppm) | Surface Tension (dyne/cm) | Shear Force of 4–30 Mesh Coal (grams) |
|---|---|---|
| 0, dry blank | — | 500 |
| 0, wet blank | 72.4 | 820 |
| 10 | 41.8 | 820 |
| 100 | 32.0 | 840 |
| 1000 | 30.0 | 830 |
| 10000 | 30.0 | 730 |

TABLE V

Sorption of Tergitol 15-S-7 by Coal from Aqueous Solution

| Initial Concentration of Tergitol 15-S-7, ppm | Surface Tension | |
|---|---|---|
| | Initial | After Mixed 2 hrs. with −100 Mesh Coal |
| 100 | 32.7 | 67.2 |
| 10,000 | 31.0 | 32.1 |

The concentration of the surfactant in the water solution is not particularly critical, and may well vary from surfactant to surfactant. As a general rule of thumb, concentrations of less than 10% surfactant appear to be relatively ineffective, and concentration of more than 50% surfactant appear to be superfluous, since no significant improvement in wet flow characteristics is observed and using more surfactant than is useful simply results in excess cost without any substantial countervailing benefit. Thus a surfactant concentration within the 10–50% range is appropriate when the treatment rate is in the range of up to 10 pints of solution per ton of coal or other water-insoluble material. As indicated by the examples set forth above, when Tergitol 15-S-7 is employed a 20% concentration of the surfactant gives excellent results with the particles tested, and when Petro AG Sp is employed a 16% concentration gives excellent results, as did a 50% solution of that surfactant. A water-insoluble solid, to which this invention relates, is one which, like coal and mineral ores, will not dissolve in water to any appreciable degree and generally will form only a suspension in water. Such substances usually have the property that when a water droplet is placed on its surface the droplet remains intact. A water soluble solid, to which the instant invention does not apply, is one which is relatively readily soluble in water, and which will to an appreciable degree form a solution in water rather than a suspension. Such substances generally have the property that when a water droplet is placed on its surface the droplet will spread into a film. Detergents and fertilizers are water-soluble; with them surfactants improve flow properties by inhibiting crystalline growth between particles and by modifying the characteristics of such crystal bridges as may form between particles. No such crystalline growth tends to take place between particles of water-insoluble solids. Thus with water-insoluble solids, as the data set forth above shows, surfactants act to improve flow characteristics in a radically different fashion from that exhibited by them in the prior art when they were used in conjunction with water-soluble solids - they reduce aqueous surface tension at the surfaces of the particles, and in so doing facilitate the flow of those particles even when they are quite wet.

While but a limited number of embodiments of the present invention have been here specifically disclosed, it will be apparent that many variations may be made therein, all within the scope of the invention as defined in the following claims.

We claim:

1. The method of improving the flow characteristics of wet, small water-insoluble solid particles which comprises (a) forming wet particles which have a surface coating of a fluid having the property of lowering surface tension in aqueous solution, said fluid comprises a water solution of a substance from the group consisting of methyl and dimethyl naphthalene sulfonates and ethoxylated linear secondary ($C_{11}$–$C_{15}$) alcohols, said water solution having a low viscosity, a high flash point, low toxicity, and (b) causing said particles to flow from one location to another, whereby caking tendencies of the wet particles are inhibited and freedom of flow of said particles between said locations is enhanced.

2. The method of claim 1, in which said particles are capable of absorbing an aqueous fluid and said coating is formed by treating said particles with said fluid in an amount in excess of that which said particles absorb.

3. The method of claim 2, in which said substance constitutes at least 10% of said fluid.

4. The method of claim 2, in which said substance constitutes about 20% of said fluid.

5. The method of claim 1, in which said substance comprises at least 10% of said fluid.

6. The method of claim 1, in which said substance comprises about 20% of said fluid.

7. The method of claim 1 in which said water-insoluble solid particles comprise coal particles.

8. The method of claim 7, in which said substance constitutes at least 10% of said fluid.

9. The method of claim 7, in which said substance constitutes about 20% of said fluid.

10. The method of claim 2, in which said fluid comprises a water solution of one or more methyl and dimethyl naphthalene sulfonates.

11. The method of claim 10, in which said substance constitutes at least 10% of said fluid.

12. The method of claim 10, in which said substance constitutes about 20% of said fluid.

13. The method of claim 10 in which said water-insoluble solid particles comprise coal particles.

14. The method of claim 1 in which said fluid comprises a water solution of one or more methyl and dimethyl naphthalene sulfonates.

15. The method of claim 14, in which said substance constitutes at least 10% of said fluid.

16. The method of claim 14, in which said substance constitutes about 20% of said fluid.

17. The method of claim 14 in which said water-insoluble solid particles comprise coal particles.

18. The method of claim 2 in which said fluid comprises a water solution of one or more ethoxylated linear secondary ($C_{11}$–$C_{15}$) alcohols.

19. The method of claim 18, in which said substance constitutes at least 10% of said fluid.

20. The method of claim 18, in which said substance constitutes about 20% of said fluid.

21. The method of claim 18 in which said water-insoluble solid particles comprise coal particles.

22. The method of claim 1 in which said fluid comprises a water solution of one or more ethoxylated linear secondary ($C_{11}$–$C_{15}$) alcohols.

23. The method of claim 22, in which said substance constitutes at least 10% of said fluid.

24. The method of claim 22, in which said substance constitutes about 20% of said fluid.

25. The method of claim 22 in which said water-insoluble solid particles comprise coal particles.

* * * * *

Disclaimer and Dedication 4,342,797.—*Alfred E. Kober,* Bridgewater; and *Mark O. Kestner,* Mendham, N.J. WET FLOW CHARACTERISTIC OF COAL AND OTHER WATER-INSOLUBLE SOLID PARTICLES. Patent dated Aug. 3, 1982. Disclaimer and Dedication filed Mar. 10, 1983, by the assignee, *Economics Laboratory, Inc.*

Hereby disclaims and dedicates to the Public the entire remaining term of said patent.

[*Official Gazette June 21, 1983.*]